United States Patent [19]

Gruber et al.

[11] Patent Number: 4,965,158

[45] Date of Patent: Oct. 23, 1990

[54] TONER COMPOSITIONS WITH MODIFIED CHARGE ENHANCING ADDITIVES

[75] Inventors: Robert J. Gruber, Pittsford, N.Y.; Raymond A. Yourd, III, Cleveland Heights, Ohio; Paul C. Julien, Webster, N.Y.; Steven B. Bolte, Rochester, N.Y.; John F. Knapp, Fairport, N.Y.

[73] Assignee: Xerox Corporation, Stamford, Conn.

[21] Appl. No.: 445,939

[22] Filed: Dec. 7, 1989

Related U.S. Application Data

[63] Continuation of Ser. No. 891,836, Aug. 1, 1986, abandoned.

[51] Int. Cl.[5] ..... G03G 9/083; G03G 13/22; G03G 9/097

[52] U.S. Cl. ..... 430/106.6; 430/110; 430/126; 430/137

[58] Field of Search ..... 430/110, 137, 106.6, 430/126

[56] References Cited

U.S. PATENT DOCUMENTS

| | | | |
|---|---|---|---|
| 4,576,888 | 3/1986 | Miyakawa et al. | 430/110 X |

FOREIGN PATENT DOCUMENTS

| | | | |
|---|---|---|---|
| 2128499 | 12/1971 | Fed. Rep. of Germany | 430/110 |
| 55-135854 | 10/1980 | Japan | 430/110 |
| 55-135855 | 10/1980 | Japan | 430/110 |
| 57-78550 | 5/1982 | Japan | 430/110 |
| 57-78556 | 5/1982 | Japan | 430/110 |
| 57-79952 | 5/1982 | Japan | 430/110 |
| 58-72949 | 5/1983 | Japan | 430/110 |
| 58-217944 | 12/1983 | Japan | 430/110 |
| 60-57852 | 4/1985 | Japan | 430/110 |
| 60-217368 | 10/1985 | Japan | 430/110 |
| 61-148454 | 7/1986 | Japan | 430/110 |

*Primary Examiner*—Roland E. Martin

*Attorney, Agent, or Firm*—Judith L. Byorick; Eugene O. Palazzo

[57] ABSTRACT

Disclosed is an improved toner composition comprised of resin particles, pigment particles, and present on the surface thereof additives comprised of a charge enhancing component sorbed on a flow aid composition.

41 Claims, No Drawings

TONER COMPOSITIONS WITH MODIFIED CHARGE ENHANCING ADDITIVES

This is a continuation, of application Ser. No. 891,836, filed Aug. 1, 1986, now abandoned.

BACKGROUND OF THE INVENTION

This invention is generally directed to toner compositions, and more specifically the present invention is directed to toner compositions, including magnetic, black and colored toner compositions with certain charge enhancing additives which impart and/or enhance the positive or negative charging characteristics of these compositions. In one important embodiment of the present invention the charge enhancing additives are formulated by the sorption of known charge additives onto the surface of various flow aid compositions, inclusive of colloidal silicas. Developer compositions with the modified charge enhancing additives of the present invention are useful for enabling the development of electrostatic latent images including color images. More specifically, toner compositions with the aforementioned modified charge enhancing additives are particularly useful in electrostatographic imaging process having incorporated therein a Viton coated fuser roll since these additives do not react substantially with Viton causing undesirable decomposition thereof which adversely effects imaging quality. Also, toner compositions with the treated additives of the present invention possesses improved admix characteristics while enabling colored toner compositions with high concentrations of colorant. Additionally, the modified charge enhancing additives of the present invention are of acceptable fusing performance characteristics in that, for example, these additives have substantially no effect on fusing performance; and further, the additives of the present invention are compatible with, for example, many alternative types of fuser rolls inclusive of Viton, Teflon, fluorinated ethylene polymers, silicones and the like. Moreover, high concentration of known charge enhancing additives can be sorbed onto the flow aid compositions, inclusive of color charge enhancing additives, some of which are highly colored without substantially altering the colors of the toner compositions thereof.

There is disclosed in a number of prior art patents developer compositions with charge enhancing additives. Thus, for example, there are illustrated in U.S. Pat. No. 3,893,935 toner compositions with certain quaternary ammonium salts as charge enhancing additives. Further, in U.S. Pat. No. 2,986,521 reversal developer compsitions comprised of toner resin particles coated with finely divided colloidal silica are illustrated. According to the disclosure of this patent, development of electrostatic latent images on negatively charged surfaces is accomplished by applying a developer composition with a positively charged triboelectric relationship in respect to the colloidal silica. Moreover, toner compositions with sulfate and sulfonate charge enhancing additives are described in U.S. Pat. No. 4,338,390, the disclosure of which is totally incorporated herein by reference. Also, U.S. Pat. No. 4,298,517, the disclosure of which is totally incorporated herein by reference, illustrates toner compositions with alkyl pyridinium halide charge enhancing additives.

Other documents disclosing toner compositions with charge control additives include U.S. Pat. Nos. 3,944,493; 4,007,293; 4,079,014 and 4,394,430. Also of interest are Japanese Patent Abstract Publications Nos. 55079-454; 57129-446; 57079-951; 57078-550; and German DE No. 3208635. Disclosed in the No. '454 abstract is a dry processable electrophotographic developer with a hard powder, such as aluminum oxide which has been previously subjected to surface treatment. The No. '446 document discloses an electrophotographic developer with silica fine powder as a charge control agent; while the No. '951 abstract illustrates a photographic developer containing a micro powder of silicate coated with alumina, and having a stable frictional charge between toner and carrier, and toner in a sleeve. In the German publication No. '635, there are disclosed toner particles and additive particles incorporated for the primary purpose of improving flowability. In the abstract of the aforementioned publication, there is mentioned as a charge control agent a metal complex dye; and further that hydrophobic colloidal silica can be selected as a flow additive. Additionally, chemically modified surface additives such as Aerosil have been disclosed in West German Patent Publication DE No. 3330380. Specifically, this publication is directed to alkoxyaminosilanes which are chemically treated with free hydroxy groups. These publications, however, do not teach the sorption of charge additives on the surface of flow aid compositions to enable the improved characteristics as illustrated hereinafter including, for example, improved admix characteristics, compatibility with various fuser rolls especially Viton fuser rolls, and the selection of low concentrations of colored dyes sorbed on the flow aid compositions preventing an adverse change in color since the dyes can be utilized in low concentrations. Further, the toner compositions of the present invention are particularly compatible with a variety of fuser rolls inclusive of Viton fuser rolls.

One Viton fuser roll selected for use in electrostatographic copying machines is comprised of a soft roll fabricated from lead oxide, and duPont Viton E-430 resin, a vinylidene fluoride hexafluoropropylene copolymer. This roll contains approximately 15 parts of lead oxide, and 100 parts of Viton E-430, which mixture is blended and cured on the roll substrate at elevated temperatures. Apparently the function of the lead oxide is to retain the liberated hydrogen fluoride gas, assist in the crosslinking reaction, contribute to degradative stability, generate unsaturation by dehydrofluorination for crosslinking, and to provide release mechanisms for the toner compositions. Excellent image quality has been obtained with Viton fuser rolls, however, in some instances there results a toner fuser compatability problem when charge control agents are part of the toner mixture. For example, it appears that certain specific charge control additives, such as quaternary ammonium compounds and alkyl pyridinium compounds, including cetyl pyridinium chloride, react with the Viton of the Viton fuser roll. For example, cetyl pyridinium chloride when part of the toner mixture appears to be catalytically decomposed by the lead oxide contained in the fuser roll resulting in a highly unsaturated compound, which polymerizes and condenses with the unsaturated Viton E-430 material. In view of this, the Viton fuser roll turns black, develops multiple surface cracks, and the surface thereof hardens thereby resulting in image quality deterioration.

Toner compositions with many of the above described charge enhancing additives are useful for causing the development of images formed on layered photoresponsive imaging devices comprised of generating layers and transport layers. These devices are charged negatively, rather than positively as is usually the situation with selenium photoreceptors, thus oa toner composition which is positively charged is required in order that the toner particles may be suitably attracted to the electrostatic latent image contained on the photoreceptor surface. Thus, efforts have been devoted to obtaining developer compositions containing toner resins which are positively charged. While many charge control additives are known for this purpose, there continues to be a need for new additives. Specifically, there continues to be a need for additives which will not interact with fuser rolls. Moreover, there continues to be a need for charge control additives which are stable at high temperatures. Also, there continues to be a need for positively or negatively charged toner and developer compositions with rapid admix charging characteristics. Further, there is a need for new charge enhancing additives, particularly those additives which can be economically prepared. Additionally, there is a need for additives which in addition to being thermally stable, are substantially nontoxic. Also, there is a need for colored toner compositions which contain positively or negatively charged resin particles, and wherein the resulting toner compositions have desirable toner admix charging. Specifically, there is a need for toner compositions having sorbed thereon modified charge enhancing additives as illustrated herein, which toner compositions can be negatively or positively charged depending, for example, on the carrier components selected; possess improved admix characteristics, that is the toner compositions acquire their charge in a rapid time period, less than 5 minutes for example; while simultaneously possessing other improved characteristics as illustrated hereinafter inclusive of acceptable electrical properties such as an appropriate positive or negative triboelectric charge.

SUMMARY OF THE INVENTION

It is an object of the present invention to provide toner and developer compositions with modified charge enhancing additives which overcome some of the above-noted disadvantages.

In another object of the present invention there are provided positively or negatively charged toner compositions which are useful for permitting the development of electrostatic latent images including color images.

In yet another object of the present invention there are provided positively charged toner compositions with charge enhancing additives sorbed onto flow aid additives.

Another object of the present invention resides in the provision of chemically modified charge enhancing additives which do not interact and/or attack fuser folls, including those comprised of Viton rubber selected for use in imaging processes.

In another object of the present invention there is provided a developer composition with positively or negatively charged toner particles, carrier particles, and specific charge enhancing additives.

Further, in another object of the present invention there are provided positively charged toner compositions which are water insensitive and have desirable admix properties.

In a further object of the present invention there are provided magentic toner compositions, and colored toner compositions with positively charged or negatively charged toner particles, carrier particles, and specific charge enhancing additives.

Additionally, in another object of the present invention there are provided toner compositions with improved electrical properties inclusive of rapid admix times; and an appropriate triboelectric charging value of a positive or negative polarity, which compositions may be black in appearance or include therein other colorants such as cyan, magenta, yellow, red, blue and green.

In yet an additional object of the present invention there are provided developer compositions comprised of toner particles with a modified charge enhancing additive as illustrative herein, and carrier particles, which compositions are useful for affecting the development of images in electrostatographic imaging processes.

These and other objects of the present invention are accomplished by providing toner compositions comprised of resin particles, pigment particles, and modified charge enhancing additives. By chemically modified, in accordance with the present invention, is meant the sorption of the charge enhancing additives onto the surface of various flow additives, inclusive of colloidal silicas such as Aerosil, and aluminlum oxides.

Accordingly, in one specific embodiment of the present invention there are provided toner compositions comprised of thermoplastic resin particles and pigment particles selected from the group consisting of black, cyan, magenta, yellow, red, blue and mixtures thereof; and wherein the toner compositions has present on its surface, for example, in an amount of from about 0.5 percent by weight based on the weight of the toner compositions, charge enhancing additives which have been sorbed onto the surface of the aforementioned flow aid additive compositions. In a more specific embodiment of the present invention, the modified charge enhancing additive can be comprised of about 10 percent of charge control additive sorbed onto about 90 percent of the flow aid component.

Charge enhancing additives that may be selected for the present invention include alkyl pyridinium halides, reference U.S. Pat. No. 4,298,672, the disclosure of which is totally incorporated herein by reference; the organic sulfates and sulfonates of U.S. Pat. No. 4,338,930, the disclosure of which is totally incorporated herein by reference; alkyl ammonium sulfates of copending application No. 645,660, entitled Toner Compositions with Ammonium sulfate Charge Enhancing Additives, the disclosure of which is totally incorporated herein by reference; and other similar charge enhancing additives providing the objectives of the present invention are accomplished. Specific examples of the aforementioned additives include cetyl pyridinium chloride, stearyl dimethylphenethyl ammonium para-toluene sulfonate, and distearyl dimethyl ammonium methyl sulfate.

The aformentioned additives are modified by the sorption thereof on the surface of flow aid components such as colloidal silicas, aluminum oxides, talc, clays and the like. More specifically, the charge enhancing additives illustrated herein are sorbed on the flow aids. This sorption can be accomplished by a number of suitable known techniques including, for example, the simple admixing of the charge enhancing additives and the flow aid components, and thereafter adding the resulting mixture by known ball milling processing, for example, to the toner composition. Generally, from about 0.1 weight percent to about 2 weight percent, and preferably 0.5 weight percent of the modified charge enhancing additive is selected, which is comprised of a mixture of charge enhancing additive and flow aid component. Other percentages may be selected providing the objectives of the present invention are achievable.

The charge enhancing additive is present on the surface of the flow aid components in an amount of from about 0.5 percent to weight to about 30 percent by weigth, and preferably in an amount of from about 5 percent by weight to about 15 percent by weight, based on the weight of the flow aid composition. Furthermore, the flow aid additive is present in an amount of from 70 percent by weight to about 99.5percent by weight, and preferably in an amount of from about 85 percent by weight to about 95 percent by weight, based on the weight of the modified charge enhancing additive comprised of a mixture of charge enhancing additive and flow aid component. This mixture is added to a toner compositon comprised of resin particles and pigment particles.

Illustrative examples of suitable toner resins selected for the toner and developer compositions of the present invention include polyamides, epoxies, diolefins, vinyl resins and polymeric esterification products of a dicarboxylic acid and a diol comprising a diphenol. Various suitable vinyl resins may be selected including homopolymers or copolymers of two or more vinyl monomers including styrene, p-chlorostyrene, unsaturated mono-olefins such as ethylene, propyelene, butylene, isobutylene and the like; vinyl halides inclusive of vinyl chloride, vinyl bromide, vinyl fluoride, vinyl acetate, vinyl propionate, vinyl benzoate, and vinyl butyrate; vinyl esters such as esters of monocarboxylic acids including methyl acrylate, ethyl acrylate, n-butylacrylate, isobutyl acrylate, dodecyl acrylate, n-octyl acrylate, 2-chloroethyl acrylate, phenyl acrylate, methylalphachloroacrylate, methyl methacrylate, ethyl methacrylate, and butyl methacrylate; acrylonitrile; methacrylonitrile; acrylamide; vinyl ethers, such as vinyl methyl ether, vinyl isobutyl ether, and vinyl ethyl ether; styrene butadiene copolymers; and mixtures thereof.

As one preferred toner resin, there can be selected the esterification products of a dicarboxylic acid and a diol comprising a diphenol. These materials are illustrated in U.S. Pat. No. 3,590,000, the disclosure of which is totally incorporated herein by reference. Other preferred toner resins include styrene/methacrylate copolymers, and styrene/butadiene copolymers, polyester resins obtained from the reaction of bis-phenol A and propylene oxide, followed by the reaction of the resulting product with fumaric acid, and branched polyester resins resulting from the reaction of dimethylterephthalate, 1,3-butanediol, 1,2-propanediol, and pentaerythritol.

The resin particles are present in a sufficient, but effective amount; thus, when 10 percent by weight of pigment, or colorant such as carbon black is contained therein, about 90 percent by weight of resin material is selected. Generally, from about 0.1 weight percent to about 2.0 weight percent, and preferably from about 0.1 weight percent to about 0.7 weight percent of the modified charge enhancing additive is selected for mixing with the toner composition; however, the charge enhancing additive of the present invention can be used in other amounts providing the objectives of the present invention are accomplished.

Numerous well known suitable pigments or dyes can be selected as the colorant for the toner particles including, for example carbon black, nigrosine dye, aniline blue, magnetites, and mixtures thereof. The pigment, which is preferably carbon black, should be present in a sufficient amounf to render the toner composition colored, thus permitting the formation of a clearly visible image. Generally, pigment particles such as carbon black are present in amounts of from about 3 percent by weight to about 20 percent by weight, based on the total weight of the toner composition; however, lesser or greater amounts of pigment particles can be selected providing the objectives of the present invention are achieved.

When the pigment particles are comprised of magnetites, which are a mixture of iron oxides ($FeO.Fe_2O_3$), including those commercially available as Mapico Black, they are present in the toner composition in an amount of from about 10 percent by weight to about 70 percent by weight, and preferably in an amount of from about 15 percent by weight to about 50 percent by weight.

Also embraced within the scope of the present invention are colored toner compositions comprised of toner resin particles, the modified charge enhancing additive illustrated herein; and as pigment or colorants components selected from the group consisting of magenta, cyan yellow, known red, blue, green, and mixtures thereof. More specfically, with regard to the generation of color images utilizing developer composition containing the modified charge enhancing additives of the present invention, illustrative examples of magenta materials that may be selected as pigments include, for example, 2,9-dimethyl-substituted quinacridone and anthraquinone dye identified in the color index as Cl 60710, Cl Dispersed Red 15, a diazo dye identified in the color index as Cl 26050, Cl Solvent Red 19, and the like. Illustrative examples of cyan materials that may be used as pigments are copper tetra-4-(octadecyl sulfonamido) phthalocyananine, X-copper phthalocyanine pigment listed in the color index as Cl 74160, Cl Pigment Blue, and Anthrathrene Blue, identified in the color index as Cl 69810, Special Blue X-2137, and the like; while illustrative examples of yellow pigments that may be selected include diarylide yellow 3,3-dichlorobenzidene acetoacetanilides, a monoazo pigment identified in the color index as Cl 12700, Cl Solvent Yellow 16, a nitrophenyl amine sulfonamide identified in the color index as Foron Yellow SE/GLN, Cl Dispersed Yellow 33, 2,5-dimethoxy-4-sulfonanilide phenylazo-4'-chloro-2,5-dimethoxy acetoacetanilide, Permanent Yellow FGL, and the like. These pigments, when used with the charge enhancing additives of the present invention, are generally present in the toner composition in an amount of from about 2 weight percent to about 15 weight percent based on the weight of the toner resin particles.

Illustrative examples of carrier components that can be selected for mixing with the toner compositions of the present invention include those that are capable of triboelectrically obtaining a charge of opposite polarity to that of the toner. Accordingly, the carrier particles of the present invention can be selected so as to be of a negative polarity thus permitting the toner composition which is positively charged to adhere to and surround the carrier components. Illustrative examples of carrier cores include steel, nickel, iron, ferrites, reference for example U.S. Pat. No. 4,042,518, the disclosure of which is totally incorporated herein by reference; and the like. Additionally, there can be selected as carrier particles nickel berry carriers as disclosed in U.S. Pat. No. 3,847,604, which carriers are comprised of nodular carrier beads of nickel, characterized by surfaces of reoccurring recesses and protrusions thereby providing particles with a relatively large external area.

The selected carrier particles generally contain thereover a coating, for example, of halogenated polymers with optional additives thereon, such as carbon black, which enable the toner composition to acquire a positive charge, and terpolymers which permit the toner composition to acquire a negative charge. Specifically, there can be selected as coatings for enabling positively charged toner compositions fluoropolymers, inclusive of polyvinylidene fluorides; tetrafluoroethylenes; copolymers of vinyl chloride, and trichlorofluoethylene; and for enabling negatively charged toner compositions terpolymers of styrene, methylmethacrylate, and a silane, such as triethoxy silane, reference for example U.S. Pat. Nos. 3,467,634; and 3,526,533, the disclosures of which are totally incorporated herein by reference. These coatings are generally present in an amount of from about 0.1 percent by weight to about 5 percent by weight of the carrier core.

Also, the diameter of the carrier particles are generally of from about 50 microns to about 1,000 microns thus allowing these particles to possess sufficient density and inertia to avoid adherence to the electrostatic images during the development process. The carrier particles can be mixed with the toner particles in various suitable combinations, however, best results are obtained when about 1 to about 5 parts of toner to about 10 parts to about 200 parts by weight of carrier are mixed.

The toner composition of the present invention can be prepared by a number of known methods, including melt blending the toner resin particles, pigment particles of colorants, followed by mechanical attrition; and thereafter adding to the toner composition surface the modified charge enhancing additives. Other methods include those well known in the art such as spray drying, melt dispersion, dispersion polymerization, and suspension polymerization. The resulting toner compositions possess positively or negatively charged toner composition depending on the carrier materials selected. These developer mixtures, especially the toner compositions, exhibit the improved properties as mentioned hereinbefore.

Further, the toner and developer compositions of the present invention may be selected for use in developing images in electrostatographic imaging systems containing therein conventional photoreceptors, such as selenium. Also useful are organic photoreceptors illustrative examples of which include layered photoresponsive devices comprised of transport layers and photogenerating layers, reference U.S. Pat. No. 4,265,990, the disclosure of which is totally incorporated herein by reference; and other similar layered photoresponsive devices. Examples of generating layers include trigonal selenium, metal phthalocyanines, metal free phthalocyanines and vanadyl phthalocyanines, while examples of charge transport layers include the aryl diamines as disclosed in U.S. Pat. No. 4,265,990. Other photoresponsive devices useful in the present invention are polyvinylcarbazole 4-dimethylaminobenzylidene; benzhydrazide; 2-benzylidene-aminocarbazole; 4-dimethamino-benzylidene; (2-nitrobenzylidene)-p-bromoaniline; 2,4-diphenyl-quinazoline; 1,2,4-triazine; 1,5-diphenyl-3-methyl pyrazoline; 2-(4'-dimethyl-amino phenyl)-benzoaxzole; 3-aminocarbazole; polyvinyl carbazole-trinitrofluorenone charge transfer complex; squaraines; selenium alloys; and hydrogenated amorphous silicon.

The following examples are being supplied to further define various species of the present invention, it being noted that these examples are intended to illustrate and not limit the scope of the present invention. Parts and percentages are by weight unless otherwise indicated.

EXAMPLE I

A. Toner Preparation

There was prepared a toner composition by melt blending at a temperature of 100° C., followed by mechanical attrition, a styrene butadiene resin, containing 89 percent by weight of styrene, and 11 percent by weight of butadiene, commercially available from Goodyear Chemical Company as Pliolite, and 10 percent by weight of carbon black Regal® 330. The resulting toner was classified in order to remove particles smaller than 5 microns in diameter.

B. Preparation of Surface Charge Control Additive

A solution of 100 milliliters of methylene chloride and 0.5 gram of dimethyloctadecylammonium methylsulfate (Sherex Chemical Company Varisoft 190-100P) was slurried with 5 grams of Aerosil R972 (Degussa) at room temperature. Thereafter, and under vacuum the methylene chloride solvent was removed, resulting in a free flowing powder.

C. Application of Surface Charge Control Additive to Toner

The above prepared toner, 100 parts, and 0.5 part of the surface charge control additive were then blended by roll milling for ½ hour using 5 parts of ⅛ inch steel shot to 1 part toner. The steel shot was then removed by sieving.

These resulted a toner composition with the styrene butadiene resin, and on the surface thereof 0.5 percent by weight of the charge control additive, which additive contained 1 part of the flow aid additive, and sorbed thereon 0.1 part of the methyl sulfate charge control additive.

A developer composition was then prepared by admixing 3 percent by weight of the above-prepared toner composition with 97 percent by weight of carrier particles comprised of a ferrite core with a coating thereover of 0.6 weight percent of a styrene methyl methacrylate triethoxy silane terpolymer, which coating contained 80 parts of the terpolymer, and dispersed therein 20 parts of Vulcan conductive carbon black. There results on the toner composition a triboelectric charge of 1.3 femtocoulombs per micron, and furher the admix time was 30 seconds.

EXAMPLE II

A number of negatively charged and positively charged black and color toner compositions were prepared by repeating the procedure of Example I, with the exceptions as noted, with the following results:

TABLE I

| Negative Charging Magenta Toners(1)-DDAMS Modified Aerosils(4): | | | | |
|---|---|---|---|---|
| Carrier | DDAMS* Conc. on Aerosil % | Tribo Femtocoulombs/ Micron | Charge Distribution | Admix Time (Min.) |
| I | 0 | −0.69 | 2.2 | 15.0 |
| I | 1 | −0.59 | 3.7 | 2.0 |
| I | 5 | −0.59 | 3.7 | 0.5 |
| I | 10 | −0.69 | 3.6 | 0.2 |
| II | 5 | −1.95 | 5.3 | 1.0 |
| II | 10 | −2.11 | 3.4 | 1.0 |

*distearyl dimethyl ammonium methyl sulfate.

TABLE II

| Negative Charging Magenta Toners(1)-CCA Modified Aerosils(4): | | | | |
|---|---|---|---|---|
| Carrier | CCA; Conc. (10% on Aerosil) | Tribo Femtocoulombs/ Micron | Charge Distribution | Admix Time (Min.) |
| I | A | −0.69 | 3.6 | 0.2 |
| I | B | −0.52 | 3.7 | 0.2 |
| I | C | −0.36 | 2.6 | 1.0 |
| I | D | −0.41 | 2.8 | 0.2 |
| I | E | −0.39 | 4.2 | 0.2 |
| I | G | −0.62 | 4.4 | 0.2 |
| I | H | −0.55 | 3.2 | 0.2 |
| I | K** | −1.23 | 4.8 | 1.0 |

**no change in toner color.

TABLE III

| Positive Charging Red Toners(2)-CCA Modified Aerosils(4): | | | | |
|---|---|---|---|---|
| Carrier | CCA; Conc. (10% on Aerosil) | Tribo Femtocoulombs/ Micron | Charge Distribution | Admix Time (Min.) |
| III | A | 1.28 | 3.5 | 0.3 |
| IV | A | 1.27 | 3.3 | 0.3 |
| III | B | 1.30 | 3.5 | 0.2 |
| III | C | 0.84 | 3.2 | 0.2 |
| III | D | 0.78 | 3.3 | 0.2 |
| III | E | 1.33 | 3.9 | 1.0 |

TABLE IV

| Negative Charging Red Toners(2)-DDAMS Modified Aerosils(4): | | | | |
|---|---|---|---|---|
| Carrier | DDAMS Conc. on Aerosil % | Tribo Femtocoulombs/ Micron | Charge Distribution | Admix Time (Min.) |
| I | 1 | −0.71 | 5.6 | 3.0 |
| I | 5 | −0.83 | 5.6 | 2.0 |
| I | 10 | −0.68 | 5.0 | 1.0 |
| II | 10 | −2.03 | 4.2 | 2.0 |

TABLE V

| Negative Charging Red Toners(2)-CCA Modified Aerosils(4): | | | | |
|---|---|---|---|---|
| Carrier | CCA; Conc. (10% on Aerosil) | Tribo Femtocoulombs/ Micron | Charge Distribution | Admix Time (Min.) |
| I | A | −0.71 | 5.6 | 3.0 |
| I | B | −0.71 | 5.7 | 1.0 |
| I | C | −0.51 | 5.4 | 1.0 |
| I | D | −0.49 | 3.1 | 0.5 |
| I | E | −0.63 | 5.6 | 0.2 |

TABLE VI

| Positive Charging Red Toners(2)-DDAMS Modified Aerosils(4): | | | | |
|---|---|---|---|---|
| Carrier | DDAMS Conc. on Aerosil % | Tribo Femtocoulombs/ Micron | Charge Distribution | Admix Time (Min.) |
| III | 10 | 1.28 | 3.5 | 0.3 |
| III | 1 | 1.17 | 4.4 | 15.0 |
| III | 5 | 1.25 | 4.5 | 1.0 |
| IV | 5 | 1.40 | 6.1 | 1.0 |
| IV | 1 | 1.82 | 5.0 | 15.0 |
| IV | 10 | 1.27 | 3.3 | 0.3 |

TABLE VII

| Positive Charging Black Toners(3)-DDAMS Modified Aerosils(4): | | | | |
|---|---|---|---|---|
| Carrier | DDAMS Conc. on Aerosil % | Tribo Femtocoulombs/ Micron | Charge Distribution | Admix Time (Min.) |
| III | 1 | 0.46 | 3.2 | 0.2 |
| III | 5 | 0.87 | 4.1 | 0.2 |
| III | 10 | 0.91 | 5.3 | 0.5 |
| IV | 10 | 1.57 | 5.5 | 0.2 |

TABLE VIII

| Positive Charging Black Toners(3) CCA Modified Aerosils(4): | | | | |
|---|---|---|---|---|
| Carrier | CCA; Conc. (10% on Aerosil) | Tribo Femtocoulombs/ Micron | Charge Distribution | Admix Time (Min.) |
| III | A | 0.91 | 5.3 | 0.5 |
| III | B | 1.12 | 5.4 | 0.3 |

TABLE IX

| Positive Charging Black Toners(3): | | | | |
|---|---|---|---|---|
| Carrier | Surface Additive | Tribo Femto-coulombs/ Micron | Charge Distribution | Admix Time (Min.) |
| III | None | 0.50 | 2.1 | 30.0 |
| III | .5% Aerosil | 0.12 | <1.0 | 15.0 |
| III | .05% DDAMS | 1.02 | 4.1 | 5.0 |
| III | .5% Aerosil + 0.5% DDAMS(5) | 0.82 | 5.6 | 5.0 |

Toner Composition:

1 90% Pliolite, 10% Hostaperm Pink
2 90% Pliolite, 9.6% Litho Scarlet, 0.4% Hostaperm Pink
3 80% Pliolite, 15% Mapico Black, 5% Regal ® 330 Carbon Black
4 Concentration of surface additive is 0.5% by weight of toner
5 Physical blend of DDAMS and Aerosil Carrier:

I Coating Wt. 0.6% of 80 parts of a methyl methacrylate, organo vinyl triethoxy silane terpolymer, and 20 parts Vulcan carbon black on 100 micron diameter ferrite
II Coating Wt. 0.6% of terpolymer on 100 micron ferrite
III Coating Wt. 0.6% of (90 parts FPC 461/10 parts Vulcan carbon black) on 100 micron toniolo steel
IV Steel coated with polyvinylidene fluoride Charge Control Agents (CCA):

A Dimethyldioctadecylammonium Methylsulfate
B Cetylpyridinium Chloride
C Cetylpyridinium Tetrafluoroborate
D Cetylpyridinium Hexafluorophosphate
E Triphenylbutylphosphonium Tetrafluoroborate
F Dibenzylbipyridinium Bromide
G Tetraphenylboron Sodium
H Tetraphenylboron Potassium
K TRH (Spilon Black), Hodagaya Chemical, Ltd.

-continued

| |
|---|
| Tribos in the range from.5 to 1.5 are desired. |
| Charge distributions greater than 2.5 are good. |
| Admix times of less than or equal to 2 are preferred. |

EXAMPLE Ii

A toner composition was then prepared by repeating the procedure of Example I with the exception that there was selected 80 percent by weight of the styrene butadiene resin; and in place of the 10 percent of carbon black particles, 5 percent by weight of Regal® 330 carbon black, and 15 percent by weight of Mapico Black.

The triboelectric charge on this toner was measured against a Carrier III at 2 percent toner concentration, such triboelectric measurements being accomplished on a toner charge spectrograph. This instrument dispenses toner particles in proportion To, the charge to diameter ratio; and with the aid of automated microscopy, can generate charge distribution histograms for selected toner size classes. The resulting toner compositions had a positive charge of a positive 0.5 femtocoulombs per micron. In contrast, with the same toner composition with Aerosil, 0.5 percent by weight, there resulted a negative charge of a minus 0.12 microcoulombs per gram.

When uncharged toner particles containing 80 percent by weight of the above Pliolite resin, 5 percent by weight of carbon black, 15 percent by weight of Mapico Black, and 0.5 percent by weight of the above modified charge enhancing additive added to the toner surface were mixed with a charged developer composition containing 0.5 percent by weight of charge enhancing additive, 5 percent by weight of Regal® 330 carbon black, 15 percent by weight of Mapico Black, and 80 percent by weight of a Pliolite styrene butadiene resin containing 89 percent by weight of styrene and 11 percent by weight of butadiene, the admix charging rate for the uncharged toner composition was less than 30 seconds. Also, admix charging experiments evidenced that the uncharged toner particles had fast charging properties when fresh uncharged toner particles were added to the charged developer composition, that is, the fresh toner partticles became positively charged in less than 30 seconds.

The above experiments were repeated for the purpose of determining the charge admix properties of a toner composition that did not contain the modified charge enhancing additive. There was thus prepared a toner composition comprised of 80 percent by weight of a styrene butadiene resin, containing 89 percent by weight of styrene, and 11 percent by weight of butadiene, commercially available as Pliolite, 5 percent by weight of Regal® 330 carbon black, and 15 percent by weight of Mapico Black. This composition has an admix rate greater than 15 minutes. These measurements were again accomplished on a toner charge spectrograph. Also, the same composition with colloidal silica alone had a charge thereon of 0.12 microcoulombs per micron, and an admix rate greater than 15 minutes.

The above developer composition with modified charge enhancing additive was then selected for developing images in a xerographic imaging device containing a layered photoreceptor comprised of a Mylar substrate overcoated with a photogenerating layer of trigonal selenium dispersed in a polyvinyl carbazole binder, and as a top layer in contact with the photogenerating layer charge transport molecules N,N'-diphenyl-N,N'-bis(3-methylphenyl)1,1'-biphenyl-4,4'-diamine, dispersed in a polycarbonate resin commercially available as Makralon, which device was prepared in accordance with the disclosure of U.S. Pat. No. 4,265,990; and there resulted high quality images. The device selected also contained a Viton fuser roll, and visual observation after 120,000 imaging cycles indicated that no damage occurred to the Viton fuser roll, that is the Viton did not turn black, did not crack and the surface did not harden; but rather remained smooth and soft although very slightly darkened.

When cetyl pyridinium chloride in an amount of 2 percent by weight was substituted for the modified charge enhancing additive in the above developer composition, and images were developed with this composition, excellent quality images were initially obtained; however, the Viton fuser roll blackened and appeared to develop surface cracks; and the Viton surface hardened after about 5,000 imaging cycles. Image quality deteriorated rapidly after about 5,000 imaging cycles, and image resolution was very poor due to the reaction of the cetyl pyridinium chloride with the Viton fuser roll.

Additionally, toner compositions containing the modified charge enhancing additive were humidity insensitive in that the initial tribocharge was only reduced from 0.91 femtocoulombs per micron (fc/u) to 0.84 fc/u, while toner compositions containing the cetyl pyridinium chloride were humidity sensitive in that the charge was significantly reduced from 1.8 femtocoulombs to 1.1 femtocoulombs. These humidity sensitivity measurements were accomplished by the following procedure.

The developer compositions involved, one of which contains the modified charge enhancing additive, and one of which contains cetyl pyridinium chloride, were placed in a humidity chamber maintained at a temperature of 80° F. at a relative humidity of 80 percent. These conditions were maintained for 24 hours. The charge on the toner composition and the admix rate were then compared to the results at room temperature at 35 percent relative humidity.

EXAMPLE III

The procedure of Example II is repeated with the exception that the toner composition prepared contains 92 percent by weight of polyester resin particles resulting from the condensation of bis-phenol A, and propylene oxide, followed by reaction of the resulting product with fumaric acid. Other toner compositions are prepared in a substantially similar manner with the exception that there are used as the toner resin particles a styrene butadiene resin containing about 90 percent by weight of styrene and 10 percent by weight of butadiene, commercially available from Goodyear Chemical Company; or stryrene n-butylmethacrylate resins, containing 58 percent by weight of styrene and 42 percent by weight of n-butylmethacrylate.

When these toner compositions with the modified additives are selected for use in the electrostatographic developing system of Example II, substantially similar results can be obtained, that is, high quality images result; the Viton fuser roll will not develop surface cracks or discolor; and the surface thereof will not harden for 50,000 imaging cycles.

With further regard to the developer compositions of the present invention, there are usually included in the carrier coating various conductive or nonconductive carbon blacks including, for example, those carbon blacks commercially available as Vulcan. These carbon blacks are generally present for the purpose of controlling the insulating and/or conductive properties of the resulting developer composition. Generally, from about 5 percent by weight to about 30 percent by weight of the aforementioned carbon blacks are incorporated into the carrier coating based on the coating weight. Additionally, other modified charge enhancing additives can be selected for adding to the surface of the present invention providing the objectives thereto are achievable.

EXAMPLE IV

Preparation of Potassium Tetraphenylborate (Charge Additive H)

A solution was prepared by dissolving 10.27 grams (0.30 moles) of Aldrich sodiumtetraphenylborate in 250 milliliters of distilled water. To this, while stirring, was added a solution of 2.36 grams (0.32 moles) of Fisher reagent grade potassium chloride dissolved in 100 milliliters of distilled water. The white precipitate that formed was stirred for 10 minutes and filtered. The precipitate was then washed with distilled water and filtered, followed by drying at 60° C. under vacuum for 24 hours. Total yield was 10.20 grams (0.28 moles) of the potassium salt of tetraphenylborate.

EXAMPLE V

Treatment of Aerosil R972 with TRH

To a Waring blender, equipped with a polytron mixer, is added 5.0grams of R972 to 500 milliliters of chloroform ($ChCl_3$). To the above, while stirring, is added 0.5 gram of TRH (Spilon Black), available from Hodagaya Chemicals, Ltd., dissolved in 20 grams of dimethyl sulfoxide (DMSO). This is stirred for 10 minutes and placed on a rotoevaporator to remove solvents. Further drying is accomplished by vacuum drying for 24 hours at 70° C. The dry treated R972 is then refluffed for use resulting in a treated silica light black in color.

Other modifications of the present invention may occur to those skilled in the art based upon a reading of the present disclosure, and these modifications are intended to be included within the scope of the present invention.

What is claimed is:

1. An improved toner composition which comprises resin particles, pigment particles, and surface additives comprising a colorless charge enhancing component which is sorbed on a flow aid composition, this component being selected from the group consisting of alkyl pyridinium halides, organic sulfonate compositions and organic sulfate compositions, of the following formulas:

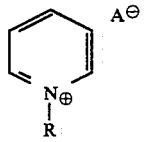

I.

and

-continued

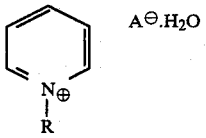

wherein R is a hydrocarbon group containing from about 8 to about 22 carbon atoms, and A is an anion, and

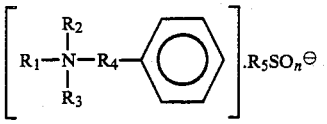

II.

wherein $R_1$ ia an alkyl group containing from about 12 carbon atoms to about 22 carbon atoms, $R_2$ is an alkyl group with from about 1 carbon atom to about 5 carbon atoms, $R_3$ is an alkyl group with from about 1 carbon atom to about 5 carbon atoms, $R_4$ is an alkylene group with from about 1 carbon atom to about 5 carbon atoms, $R_5$ is a tolyl group or an alkyl group of from about 1 carbon atom to about 3 carbon atoms, and n is the number 3 or 4; and distearyl dimethyl ammonium methyl sulfate, said flow aid being selected from the group consisting of colloidal silicas and aluminum oxides.

2. A toner composition in accordance with claim 1 wherein the resin particles are selected from the group consisting of polyesters, styrene butadiene copolymers, styrene methacrylate copolymers, and styrene acrylate copolymers.

3. A toner composition in accordance with claim 2 wherein the polyester results from the condensation reaction of dimethylterephthalate, 1,3-butanediol, and pentaerythritol.

4. A toner composition in accordance with claim 2 wherein the styrene butadiene copolymer contains 89 percent by weight of styrene, and 11 percent by weight of butadiene.

5. A toner composition in accordance with claim 1 wherein the pigment is carbon black.

6. A toner composition in accordance with claim 1 wherein the pigment is a magnetite.

7. A toner composition in accordance with claim 1 wherein the charge enhancing additive is cetyl pyridinium chloride.

8. A toner composition in accordance with claim 1 wherein the charge enhancing additive is stearyl dimethyl phenethyl ammonium para-toluene sulfonate.

9. A toner composition in accordance with claim 1 wherein the pigment is selected from the group consisting of cyan, magenta, yellow, red, blue, green and mixtures thereof.

10. A toner composition in accordance with claim 1 wherein the flow additive is a colloidal silica.

11. A toner composition in accordance with claim 1 wherein the flow additive is an aluminum oxide.

12. A developer composition comprised of the toner composition of claim 1 and carrier particles.

13. A developer composition in accordance with claim 12 wherein the carrier particles consist of a steel core coated with a material selected from the group consisting of a polychlorotrifluoroethylene-co-vinylchloride copolymer, a polyvinylidene fluoropolymer, and a terpolymer of styrene, methacrylate, and vinyltriethoxysilane.

14. A developer composition in accordance with claim 12 wherein the resin particles are selected from the group consisting of polyesters, styrene butadiene copolymers, and styrene methacrylate copolymers.

15. A developer composition in accordance with claim 14 wherein the polyester results from the condensation reaction of dimethylterephthalate, 1,3-butanediol, and pentaethylthritol.

16. A developer composition in accordance with claim 14 wherein the styrene butadiene copolymer contains 89 percent by weight of styrene, and 11 percent by weight of butadiene.

17. A developer composition in accordance with claim 12 wherein the pigments is carbon black.

18. A developer composition in accordance with claim 12 wherein the pigment is a magnetite.

19. A developer composition in accordance with claim 12 wherein the charge enhancing additive is cetyl pyridinium chloride.

20. A developer composition in accordance with claim 12 wherein the charge enhancing additive is selected from the group consisting of stearyl dimethyl phenethyl ammonium para-toluene sulfonate, and distearyl dimethyl ammonium methyl sulfate.

21. A developer composition in accordance with claim 12 wherein the pigment is selected from the group consisting of cyan, magenta, yellow, red, blue, green and mixtures thereof.

22. A developer composition in accordance with claim 12 wherein the flow additive is a colloidal silica.

23. A toner composition in accordance with claim 1 wherein R is an alkyl group containing from about 12 carbon atoms to about 22 carbon atoms, $R_1$ is an alkyl group of from about 14 carbon atoms to about 18 carbon atoms, and n is the number 3.

24. A toner composition in accordance with claim 1 wherein R is an alkyl group containing from about 12 carbon atoms to about 18 carbon atoms, and $R_1$ is an alkyl group containing from about 14 carbon atoms to about 18 carbon atoms, and n is the number 4.

25. A method for developing latent images which comprises forming an electrostatic latent image on a negatively charged imaging member, contacting the image with the toner composition of claim 1, followed by transferring the image to a suitable substrate, and permanently affixing the image thereto.

26. A method of imaging in accordance with claim 25 wherein the resin particles are comprised of a polyester resulting from the condensation reaction of dimethyl terephthalate, 1,3 butanediol, and pentaerythritol.

27. A method of imaging in accordance with claim 25 wherein the pigment is carbon black.

28. A method of imaging in accordance with claim 25 wherein the pigment is a magnetite.

29. A method of imaging in accordance with claim 25 wherein the pigment is present in an amount of from about 3 percent by weight to about 20 percent by weight.

30. A method of imaging in accordance with claim 25 wherein the resin particles are selected from the group consisting of styrene butadiene copolymers and styrene methacrylate copolymers.

31. An improved toner composition consisting essentially of resin particles, pigment particles, and surface additives which consist essentially of a colorless charge enhancing component which is sorbed on a flow aid composition, this component being selected from the group consisting of alkyl pyridinium halides, organic sulfonate compositions, and organic sulfate compositions of the following formulas:

I.

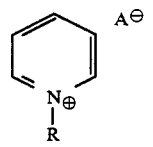

and

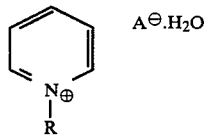

wherein R is a hydrocarbon group containing from about 8 to about 22 carbon atoms, and A is an anion, and

II.

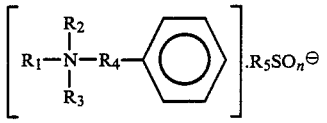

wherein $R_1$ is an alkyl group containing from about 12 carbon atoms to about 22 carbon atoms, $R_2$ is an alkyl group with from about 1 carbon atom to about 5 carbon atoms, $R_3$ is an alkyl group with from about 1 carbon atom to about 5 carbon atoms, $R_4$ is an alkylene group with from about 1 carbon atom to about 5 carbon atoms, $R_5$ is a tolyl group or an alkyl group of from about 1 carbon atom to about 3 carbon atoms, and n is the number 3 or 4; and distearyl dimethyl ammonium methyl sulfate, said flow aid being selected from the group consisting of colloidal silicas and aluminum oxides.

32. A toner composition in accordance with claim 31 wherein the flow additive is a colloidal silica.

33. A toner composition in accordance with claim 31 wherein the flow additive is an aluminum oxide.

34. A toner composition in accordance with claim 31 wherein the charge enhancing additive is cetyl pyridinium chloride.

35. A toner composition in accordance with claim 31 wherein the charge enhancing additive is selected from the group consisting of stearyl dimethyl phenethyl ammonium para-toluene sulfonate and distearyl dimethyl ammonium methyl sulfate.

36. A toner composition in accordance with claim 31 wherein the resin particles are a polyester resulting from the condensation reaction of dimethyl terephthalate, 1,3-butanediol, and pentaerythritol.

37. A toner composition in accordance with claim 31 wherein the resin particles are a styrene butadiene copolymer containing 89 percent by weight of styrene and 11 percent by weight of butadiene.

38. A developer composition comprising the toner composition of claim 31 and carrier particles consisting of a steel core coated with a material selected from the group consisting of a polychlorotrifluoroethylene-co-vinylchloride copolymer, a polyvinylidene fluoropolymer, and a terpolymer of styrene, methacrylate, and vinyltriethoxysilane.

39. A toner composition in accordance with claim 21 wherein the toner composition exhibits rapid admix times and compatibility with fusing rolls comprising Viton rubber.

40. A toner composition in accordance with claim 1 wherein the toner is positively charged.

41. A toner composition in accordance with claim 31 wherein the toner is positively charged.

* * * * *